US011793363B2

(12) United States Patent
McLain

(10) Patent No.: US 11,793,363 B2
(45) Date of Patent: Oct. 24, 2023

(54) ELECTRIC TOOTHBRUSH STOWAGE DEVICE

(71) Applicant: John McLain, Freeland, WA (US)

(72) Inventor: John McLain, Freeland, WA (US)

( * ) Notice: Subject to any disclaimer, the term of this patent is extended or adjusted under 35 U.S.C. 154(b) by 0 days.

(21) Appl. No.: 17/665,975

(22) Filed: Feb. 7, 2022

(65) Prior Publication Data

US 2023/0248183 A1 Aug. 10, 2023

(51) Int. Cl.
*A47K 1/09* (2006.01)

(52) U.S. Cl.
CPC ..... *A47K 1/09* (2013.01)

(58) Field of Classification Search
CPC .. A47K 1/09; A47K 2201/025; A61C 17/224; A61C 17/22; A47B 17/02; A46B 2200/1066; A46B 17/00; A45D 44/18; A47G 29/08
USPC ..... 211/70.6, 65, 119.009, 60.1
See application file for complete search history.

(56) References Cited

U.S. PATENT DOCUMENTS

| | | | | |
|---|---|---|---|---|
| 1,551,434 | A * | 8/1925 | Shiffer | A47K 1/09 132/286 |
| 2,200,046 | A * | 5/1940 | Straus | A45D 27/29 312/207 |
| 3,895,775 | A * | 7/1975 | Norton | A47G 1/215 248/476 |
| 4,442,830 | A | 4/1984 | Markau | |
| 5,645,177 | A * | 7/1997 | Lin | B25H 3/04 211/69.5 |
| D476,485 | S | 7/2003 | Mulder | |
| 7,721,899 | B2 | 5/2010 | Lambert | |
| 2001/0003332 | A1* | 6/2001 | Ventnor | A47K 1/09 211/70.6 |
| 2002/0166874 | A1* | 11/2002 | DeVaux | A47K 1/09 222/181.3 |
| 2007/0220754 | A1* | 9/2007 | Barbaro | A45D 27/29 30/41 |
| 2009/0127214 | A1* | 5/2009 | Kruger | A47B 88/90 211/65 |
| 2009/0184015 | A1 | 7/2009 | Ruppert | |
| 2012/0138491 | A1 | 6/2012 | Goss | |
| 2018/0055291 | A1 | 3/2018 | Wazawa | |

FOREIGN PATENT DOCUMENTS

| | | | | |
|---|---|---|---|---|
| JP | 10005045 A * | 1/1998 | | A61C 17/224 |
| JP | 11056879 A * | 3/1999 | | |
| JP | 5138710 B2 * | 2/2013 | | Y02E 60/10 |

* cited by examiner

*Primary Examiner* — Hiwot E Tefera

(57) ABSTRACT

An electric toothbrush stowage device for sanitary stowing and charging of an electric toothbrush includes a housing, which comprises a base that is positionable on a surface so that the housing extends upwardly from the surface. A charging plug is engaged to the housing proximate to an upper end of the housing. The charging plug is complementary to a charging port of an electric toothbrush and is insertable into the charging port to charge a battery of the electric toothbrush. A coupler, which is engaged to the housing, selectively engages a neck of the electric toothbrush so that a handle and a brush head of the electric toothbrush extend toward the upper end of the housing and the base, respectively.

13 Claims, 7 Drawing Sheets

ELECTRIC TOOTHBRUSH STOWAGE DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to stowage devices and more particularly pertains to a new stowage device for sanitary stowing and charging of an electric toothbrush. The present invention discloses a stowage device comprising a housing, which is configured to engaging an electric toothbrush so that the electric toothbrush is stowed in an inverted configuration. The housing comprises a charging plug, which is compatible with a charging port of the electric toothbrush. A battery of the electric toothbrush is chargeable while the electric toothbrush is stowed.

(2) Description of Related Art Including Information Disclosed Under 37 CFR 1.97 and 1.98

The prior art relates to stowage devices. The prior art discloses a variety of racks and holding devices for using in storing toothbrushes, typically manual toothbrushes, so that the brush heads are positioned below the brush handles, that is, inverted. What is lacking in the prior art is a stowage device comprising a housing that is configured to engage an electric toothbrush so that the electric toothbrush is stowed in an inverted configuration. The housing comprises a charging plug, which is compatible with a charging port of the electric toothbrush, so that a battery of the electric toothbrush is chargeable while the electric toothbrush is stowed.

BRIEF SUMMARY OF THE INVENTION

An embodiment of the disclosure meets the needs presented above by generally comprising a housing, which comprises a base that is configured to be positioned on a surface so that the housing extends upwardly from the surface. A charging plug is engaged to the housing proximate to an upper end of the housing. The charging plug is complementary to a charging port of an electric toothbrush and is configured for insertion into the charging port to charge a battery of the electric toothbrush. A coupler is engaged to the housing and is configured to selectively engage a neck of the electric toothbrush so that a handle and a brush head of the electric toothbrush extend toward the upper end of the housing and the base, respectively.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
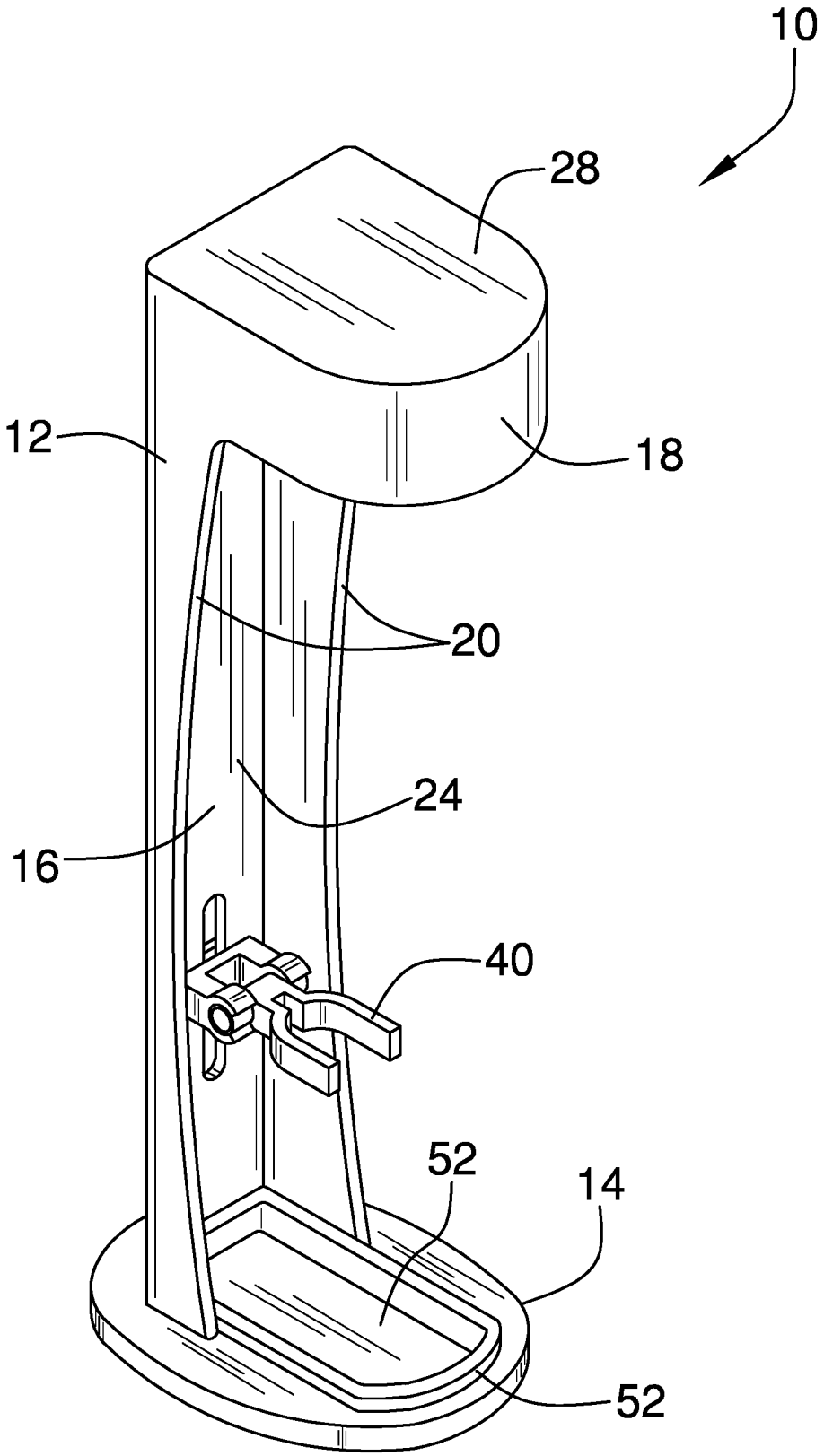
FIG. 1 is an isometric perspective view of an electric toothbrush stowage device according to an embodiment of the disclosure.

With reference now to the drawings, and in particular to FIGS. 1 through 7 thereof, a new stowage device embodying the principles and concepts of an embodiment of the disclosure and generally designated by the reference numeral 10 will be described.

Figure 2:
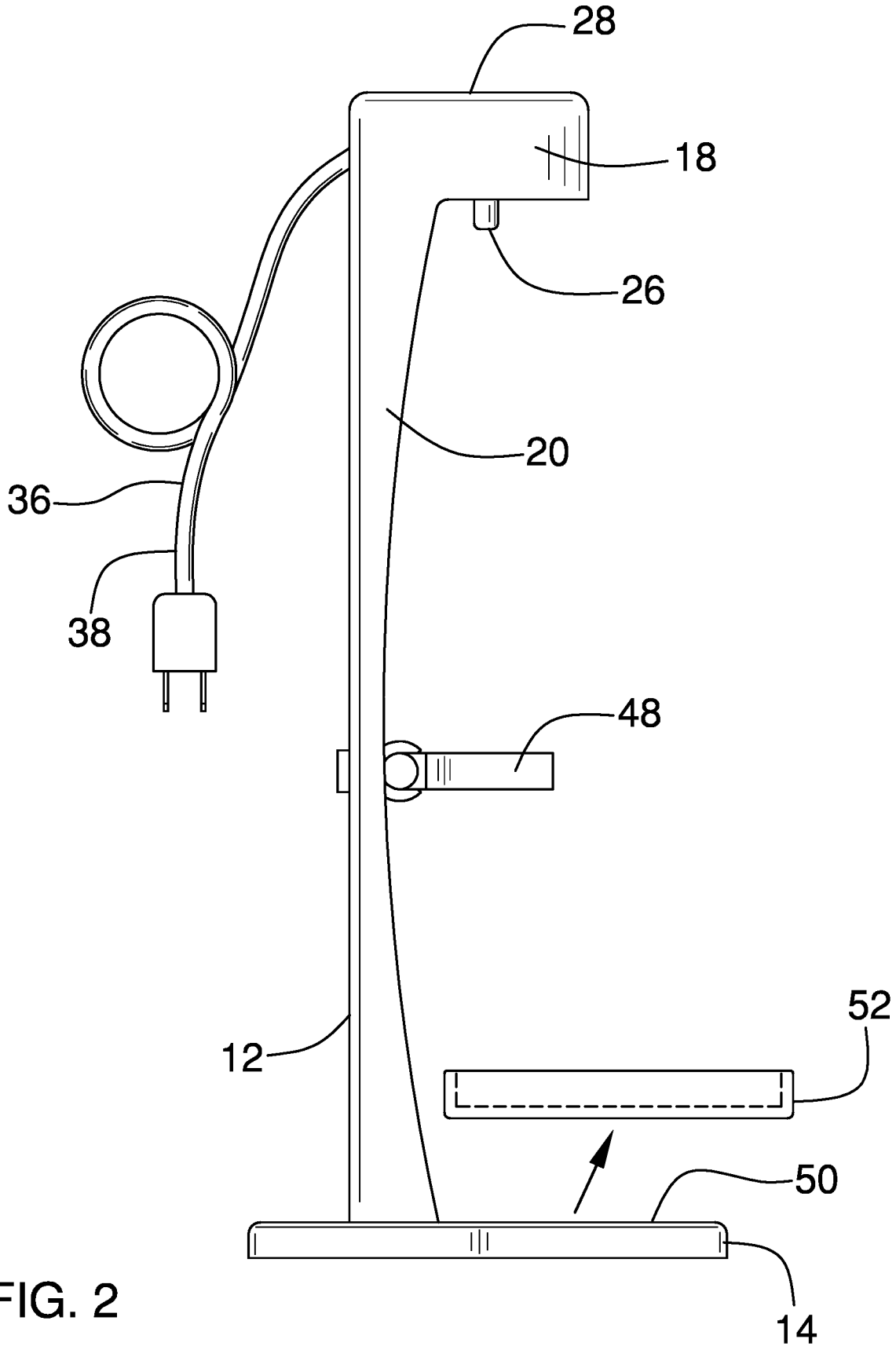
FIG. 2 is a side view of an embodiment of the disclosure.

As best illustrated in FIGS. 1 through 7, the electric toothbrush stowage device 10 generally comprises a housing 12, which comprises a base 14 that is configured to be positioned on a surface so that the housing 12 extends upwardly from the surface. The housing 12 comprises a rear wall 16, which is engaged to and which extends substantially perpendicularly from the base 14. A top piece 18 is engaged to the rear wall 16 distal from the base 14 and extends codirectionally with the base 14 from the rear wall 16. The housing 12 also may comprise a pair of side walls 20. Each side wall 20 is engaged to a respective opposed edge 22 of the rear wall 16 and extends between the base 14 and the top piece 18. The side walls 20, the rear wall 16, the base 14, and the top piece 18 define a recess 24. The sidewalls may be arcuate so that the recess 24 is deeper proximate to the base 14 and the top piece 18, as shown in FIG. 2.

Figure 3:
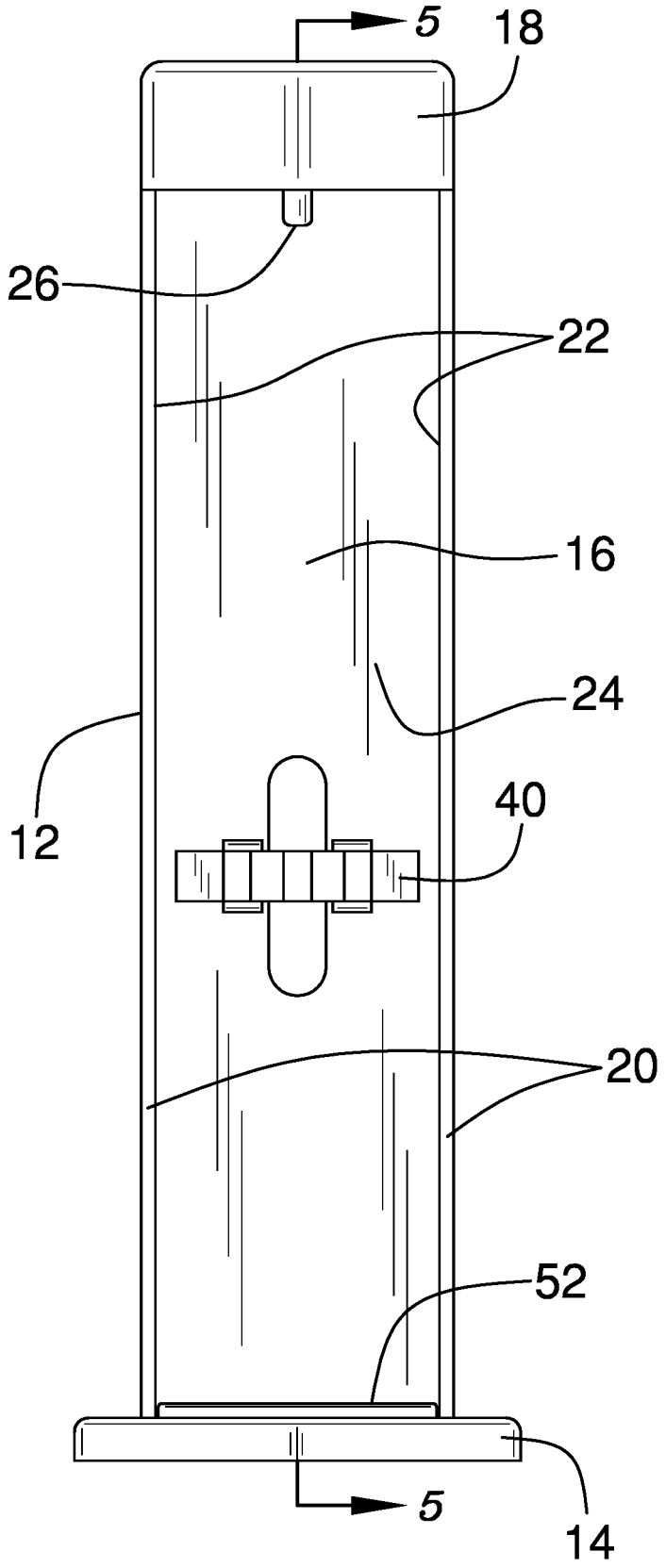
FIG. 3 is a front view of an embodiment of the disclosure.
Figure 7:
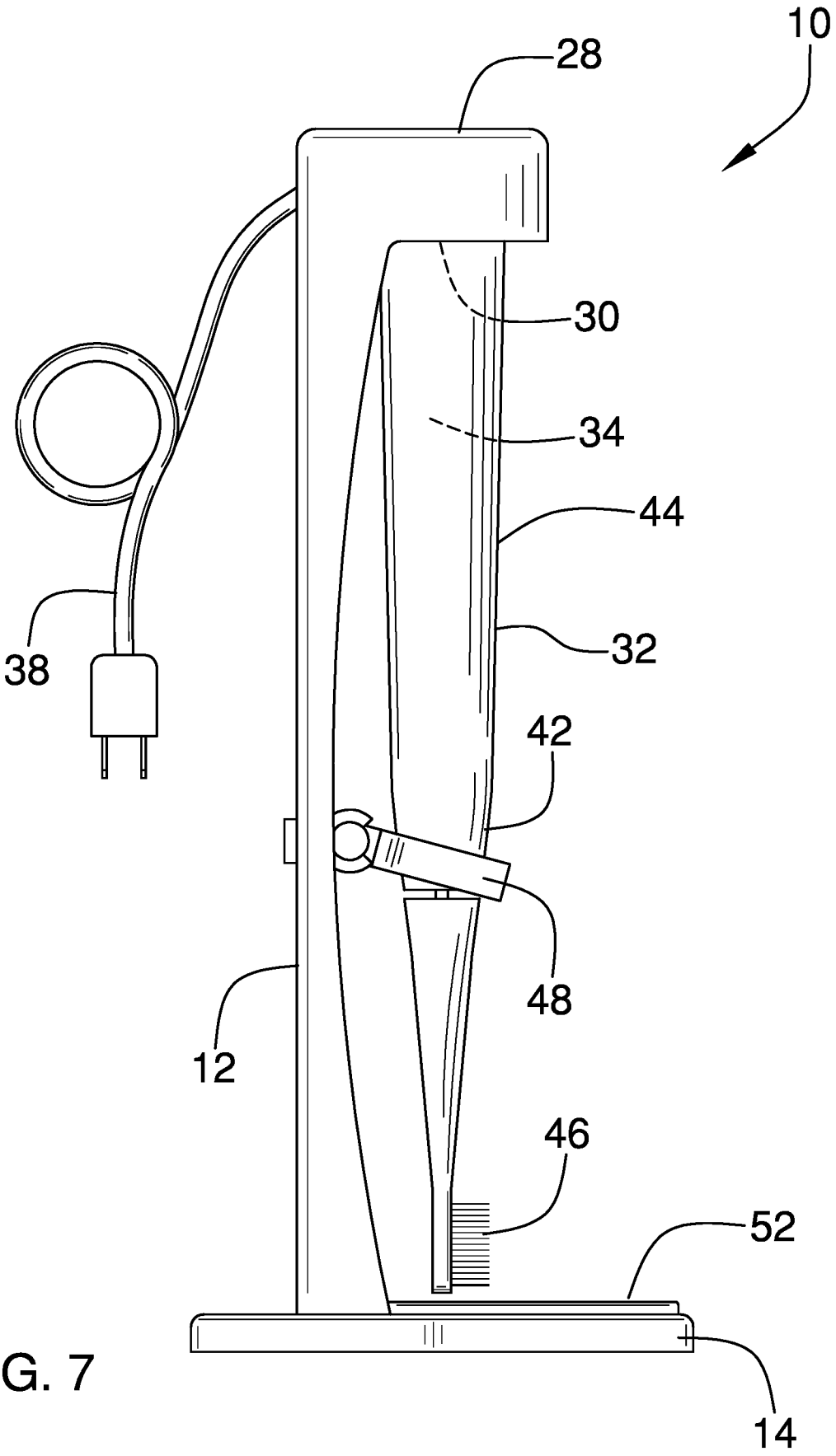
FIG. 7 is an in-use view of an embodiment of the disclosure.

A charging plug 26 is engaged to the housing 12 proximate to an upper end 28 of the housing 12. The charging plug 26 is complementary to a charging port 30 of an electric toothbrush 32 and is configured for insertion into the charging port 30 to charge a battery 34 of the electric toothbrush 32, as shown in FIG. 7. The charging plug 26 may be engaged to the top piece 18, as shown in FIG. 3.

Figure 6:
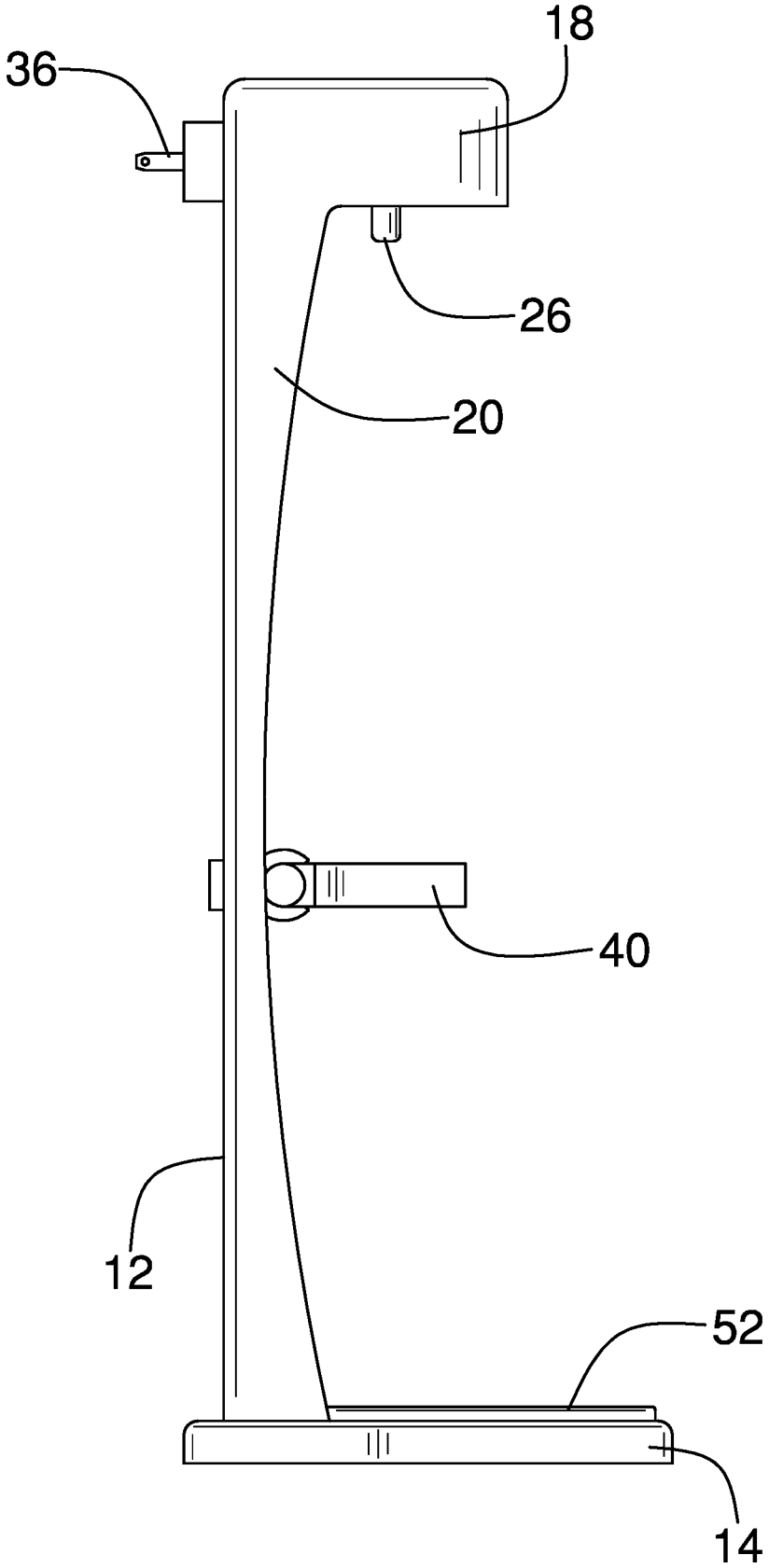
FIG. 6 is a side view of an embodiment of the disclosure.

A power connector 36 is engaged the housing 12 and is operationally engaged to the charging plug 26, as shown in FIG. 6. The power connector 36 is configured to operationally engage a source of electrical current to charge the battery 34 of the electric toothbrush 32. With the power connector 36 directly engaged to the housing 12, the housing 12 can be positioned in abutment to a wall in which an electrical socket (not shown) is positioned. As shown in FIG. 7, the power connector 36 may comprise a power cord 38, which is engaged to and which extends from the housing 12. The power cord 38 can be used to engage an electrical socket more distal from the housing 12.

A coupler 40 is engaged to the housing 12 and is configured to selectively engage a neck 42 of the electric toothbrush 32 so that a handle 44 and a brush head 46 of the electric toothbrush 32 extend toward the upper end 28 of the housing 12 and the base 14, respectively. Thus positioned, any moisture on the brush head 46 drains to the base 14, thus providing for more sanitary stowage of the electric toothbrush 32 relative to upright stowage.

The coupler 40 may comprise a jaw 48, which is hingedly engaged to the housing 12. The jaw 48 is spring loaded so that the jaw 48 is tensioned upon being hinged toward the base 14. The jaw 48 is configured for selective insertion of the neck 42 of the electric toothbrush 32 so that the electric toothbrush 32 is removably engaged to the housing 12. As the neck 42 of the electric toothbrush 32 is inserted into the jaw 48, the jaw 48 is hinged toward the base 14, positioning the jaw 48 to rebound such that the charging plug 26 is inserted into the charging port 30. The coupler 40 may comprise other coupling means, such as, but not limited to, rings, clamps, and the like.

Figure 4:
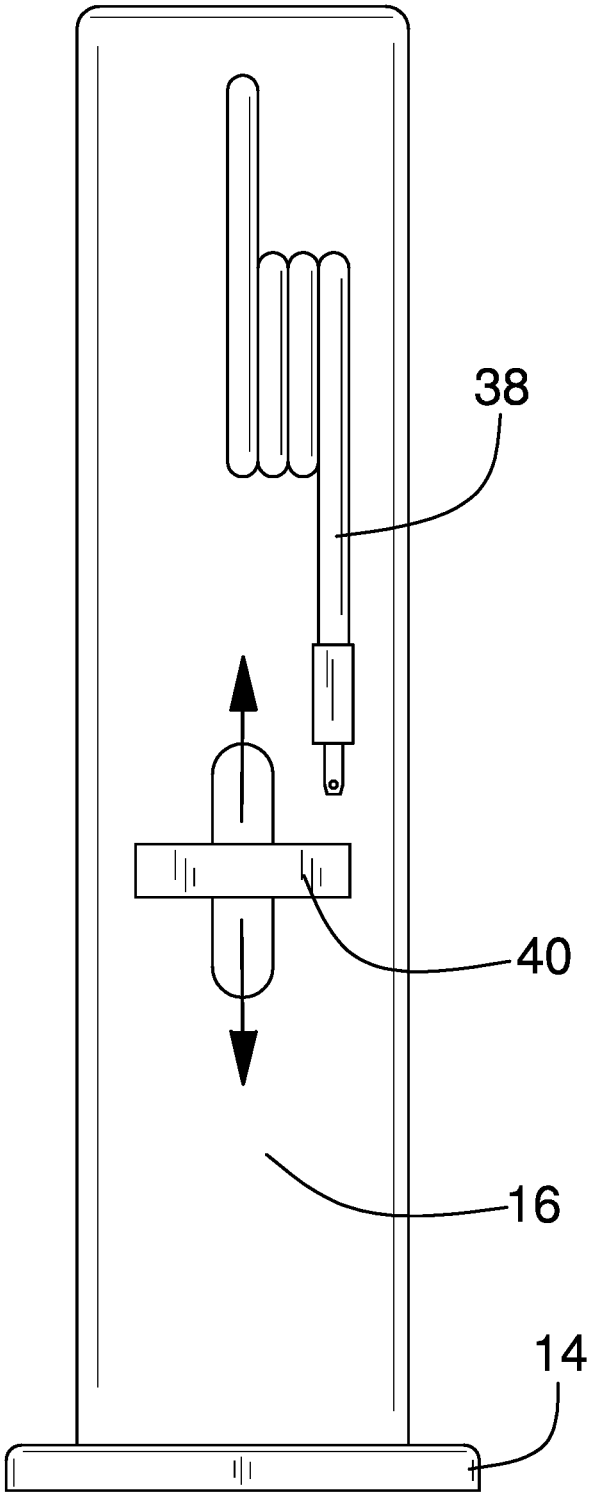
FIG. 4 is a rear view of an embodiment of the disclosure.
Figure 5:
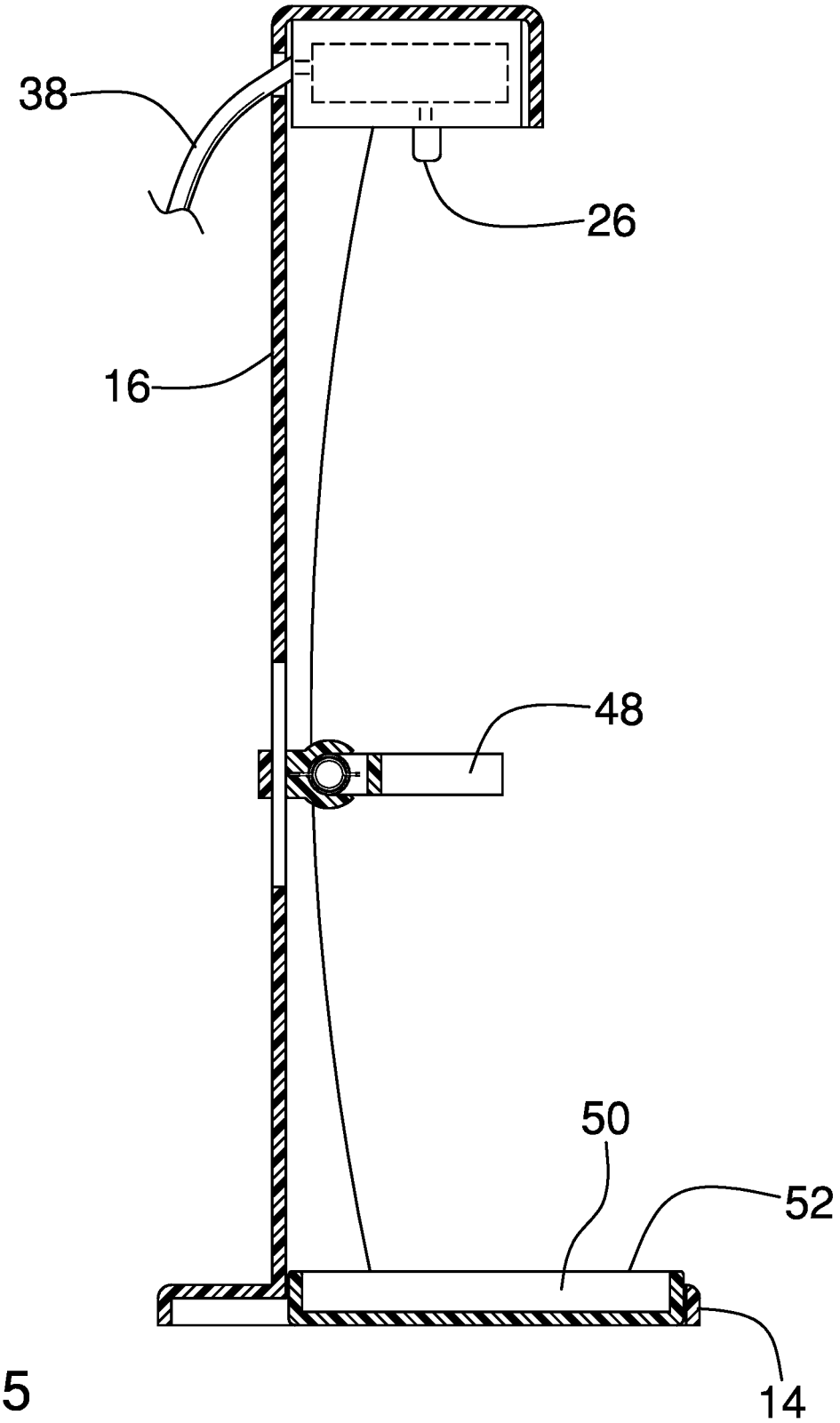
FIG. 5 is a cross-sectional view of an embodiment of the disclosure.

The coupler 40 may be slidably engaged to the housing 12, as shown in FIGS. 4 and 5. The coupler 40 thus is selectively positionable between the base 14 and the upper end 28 of the housing 12, allowing it to be adjusted to accommodate electric toothbrushes 32 of various lengths.

A depression 50 extends into the base 14 so that the depression 50 is positioned below the brush head 46 of the electric toothbrush 32. The depression 50 is configured to collect liquid dripping from the brush head 46. A tray 52, which is complementary to the depression 50, is selectively positionable in the depression 50. The tray 52 can be removed from the depression 50, emptied, and cleaned, as needed.

In use, the base 14 of the housing 12 is positioned on a surface, such as a counter next to a sink. The power cord 38 is extended to and is operationally engaged to an electrical socket to provide power to the electric toothbrush stowage device 10. The neck 42 of the electric toothbrush 32 is inserted into the jaw 48, causing it to hinge toward the base 14. The electric toothbrush 32 then is pivoted into the recess 24 and released, whereupon the jaw 48 rebounds so that the charging plug 26 inserts into the charging port 30.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An electric toothbrush stowage device comprising:

a housing having a base configured for positioning on a surface, such that the housing extends upwardly from the surface;

a charging plug engaged to the housing proximate to an upper end of the housing, the charging plug being complementary to a charging port of an electric toothbrush, wherein the charging plug is configured for insertion into the charging port of the electric toothbrush for charging a battery of the electric toothbrush;

a coupler engaged to the housing and being configured for selectively engaging a neck of the electric toothbrush, such that a handle and a brush head of the electric toothbrush extend toward the upper end of the housing and the base, respectively;

wherein the housing comprises a rear wall engaged to and extending substantially perpendicularly from the base, a top piece engaged to the rear wall distal from the base and extending codirectionally with the base from the rear wall, the charging plug being engaged to the top piece, and a pair of side walls, each side wall being engaged to a respective opposed edge of the rear wall and extending between the base and the top piece, such that the side walls, the rear wall, the base, and the top piece define a recess;

a power connector engaged to the housing and being operationally engaged to the charging plug, wherein the power connector is configured for operationally engaging a source of electrical current for charging the battery of the electric toothbrush; and wherein the coupler is slidably engaged to the housing, such that the coupler is selectively positionable between the base and the upper end of the housing.

2. The electric toothbrush stowage device of claim 1, wherein the sidewalls are arcuate, such that the recess is deeper proximate to the base and the top piece.

3. The electric toothbrush stowage device of claim 1, wherein the power connector comprises a power cord engaged to and extending from the housing.

4. The electric toothbrush stowage device of claim 1, wherein the coupler comprises a jaw hingedly engaged to the housing, the jaw being spring loaded, such that the jaw is tensioned upon being hinged toward the base, wherein the jaw is configured for selective insertion of the neck of the electric toothbrush, such that the electric toothbrush is removably engaged to the housing and such that the jaw is hinged toward the base, positioning the jaw for rebounding such that the charging plug is inserted into the charging port.

5. The electric toothbrush stowage device of claim 1, further including a depression extending into the base, such that the depression is positioned below the brush head of the electric toothbrush, wherein the depression is configured for collecting liquid dripping from the brush head.

6. The electric toothbrush stowage device of claim 5, further including a tray complementary to the depression, such that the tray is selectively positionable in the depression.

7. An electric toothbrush stowage system comprising:

an electric toothbrush;

a housing having a base configured for positioning on a surface, such that the housing extends upwardly from the surface;

a charging plug engaged to the housing proximate to an upper end of the housing, the charging plug being complementary to a charging port of an electric toothbrush, such that the charging plug is selectively for insertable into the charging port for charging a battery of the electric toothbrush; and a coupler engaged to the housing, the coupler being selectively engageable to a neck of the electric toothbrush, such that a handle and a brush head of the electric toothbrush extend toward the upper end of the housing and the base, respectively;

wherein the housing comprises a rear wall engaged to and extending substantially perpendicularly from the base, a top piece engaged to the rear wall distal from the base and extending codirectionally with the base from the rear wall, the charging plug being engaged to the top piece, and a pair of side walls, each side wall being engaged to a respective opposed edge of the rear wall and extending between the base and the top piece, such that the side walls, the rear wall, the base, and the top piece define a recess;

a power connector engaged to the housing and being operationally engaged to the charging plug, wherein the power connector is configured for operationally engaging a source of electrical current for charging the battery of the electric toothbrush; and wherein the coupler is slidably engaged to the housing, such that the coupler is selectively positionable between the base and the upper end of the housing.

8. The electric toothbrush stowage system of claim 7, wherein the sidewalls are arcuate, such that the recess is deeper proximate to the base and the top piece.

9. The electric toothbrush stowage system of claim 7, wherein the power connector comprises a power cord engaged to and extending from the housing.

10. The electric toothbrush stowage system of claim 7, wherein the coupler comprises a jaw hingedly engaged to the housing, the jaw being spring loaded, such that the jaw is tensioned upon being hinged toward the base, the neck of the electric toothbrush being selectively insertable into the jaw, such that the electric toothbrush is removably engaged to the housing, the jaw being hinged toward the base upon insertion of the neck, positioning the jaw for rebounding such that the charging plug is inserted into the charging port.

11. The electric toothbrush stowage system of claim 7, further including a depression extending into the base, such that the depression is positioned below the brush head of the electric toothbrush, wherein the depression is configured for collecting liquid dripping from the brush head.

12. The electric toothbrush stowage system of claim 11, further including a tray complementary to the depression, such that the tray is selectively positionable in the depression.

13. An electric toothbrush stowage device comprising:

a housing having a base configured for positioning on a surface, such that the housing extends upwardly from the surface, the housing comprising:

a rear wall engaged to and extending substantially perpendicularly from the base, a top piece engaged to the rear wall distal from the base and extending codirectionally with the base from the rear wall, and a pair of side walls, each side wall being engaged to a respective opposed edge of the rear wall and extending between the base and the top piece, such that the side walls, the rear wall, the base, and the top piece define a recess, the sidewalls being arcuate, such that the recess is deeper proximate to the base and the top piece;

a charging plug engaged to the housing proximate to an upper end of the housing, the charging plug being complementary to a charging port of an electric toothbrush, wherein the charging plug is configured for insertion into the charging port of the electric toothbrush for charging a battery of the electric toothbrush, the charging plug being engaged to the top piece;

a power connector engaged to the housing and being operationally engaged to the charging plug, wherein the power connector is configured for operationally engaging a source of electrical current for charging the battery of the electric toothbrush, the power connector comprising a power cord engaged to and extending from the housing;

a coupler engaged to the housing and being configured for selectively engaging a neck of the electric toothbrush, such that a handle and a brush head of the electric toothbrush extend toward the upper end of the housing and the base, respectively, the coupler comprising a jaw hingedly engaged to the housing, the jaw being spring loaded, such that the jaw is tensioned upon being hinged toward the base, wherein the jaw is configured for selective insertion of the neck of the electric toothbrush, such that the electric toothbrush is removably engaged to the housing and such that the jaw is hinged toward the base, positioning the jaw for rebounding such that the charging plug is inserted into the charging port, the coupler being slidably engaged to the housing, such that the coupler is selectively positionable between the base and the upper end of the housing;

a depression extending into the base, such that the depression is positioned below the brush head of the electric toothbrush, wherein the depression is configured for collecting liquid dripping from the brush head; and a tray complementary to the depression, such that the tray is selectively positionable in the depression.

* * * * *